US006543552B1

(12) United States Patent
Metcalfe et al.

(10) Patent No.: US 6,543,552 B1
(45) Date of Patent: Apr. 8, 2003

(54) METHOD AND APPARATUS FOR DRILLING AND LINING A WELLBORE

(75) Inventors: Paul David Metcalfe, Peterculter (GB); Neil Andrew Abercrombie Simpson, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/469,643

(22) Filed: Dec. 22, 1999

(30) Foreign Application Priority Data

| | | |
|---|---|---|
| Dec. 22, 1998 | (GB) | 9828234 |
| Jan. 15, 1999 | (GB) | 9900835 |
| Oct. 8, 1999 | (GB) | 9923783 |
| Oct. 13, 1999 | (GB) | 9924189 |

(51) Int. Cl.[7] ..... E21B 7/00; E21B 7/20; E21B 23/00; B21D 41/02

(52) U.S. Cl. ..... 175/57; 175/171; 175/258; 166/208; 166/212; 166/277; 166/382; 72/393

(58) Field of Search ..... 72/97, 150, 148, 72/393, 75; 166/277, 382, 206, 384, 207, 208, 212, 217, 98; 175/23, 57, 171, 258

(56) References Cited

U.S. PATENT DOCUMENTS

| | | | |
|---|---|---|---|
| 761,518 A | 5/1904 | Lykken | |
| 988,504 A | 3/1911 | Wiet | |
| 1,301,285 A | 4/1919 | Leonard | |
| 1,324,303 A | 12/1919 | Carmichael | |
| 1,545,039 A | 7/1925 | Deavers | |
| 1,561,418 A | 11/1925 | Duda | |
| 1,569,729 A | 1/1926 | Duda | |
| 1,597,212 A | 8/1926 | Spengler | |
| 1,880,218 A | 10/1932 | Simmons | |
| 1,930,825 A | 10/1933 | Raymond | |
| 1,981,525 A | 11/1934 | Price | 166/4 |

(List continued on next page.)

FOREIGN PATENT DOCUMENTS

| | | | |
|---|---|---|---|
| DE | 3 213 464 | 10/1983 | B23D/45/12 |
| DE | 4 133 802 | 10/1992 | F16L/9/12 |

(List continued on next page.)

OTHER PUBLICATIONS

Metcalfe, P.—"Expandable Slotted Tubes Offer Well Design Benefits", *Petroleum Engineer International*, vol. 69, No. 10 (Oct. 1996), pp. 60–63—XP000684479.

(List continued on next page.)

*Primary Examiner*—David Bagnell
*Assistant Examiner*—Jennifer H Gay
(74) *Attorney, Agent, or Firm*—Moser, Patterson & Sheridan, L.L.P.

(57) ABSTRACT

A method and apparatus is provided for drilling and lining a wellbore in one downhole trip. The method comprises mounting a drill bit on a drill string including a section of expandable tubing and providing a tubing expander in the string, then rotating the drill bit and advancing the drill string through a bore, then passing the expander through the expandable tubing to expand the tubing, wherein the expandable tubing is deformed by compressive plastic deformation of the tubing with a localised reduction in wall thickness, resulting in a subsequent increase in tubing diameter, and then retrieving the drill bit from the bore through the expanded tubing. The apparatus comprises a drill string including a section of expandable tubing, a drill bit mounted on the string, and a tubing expander mounted on the string, wherein the expandable tubing is deformed by compressive plastic deformation of the tubing with a localised reduction in wall thickness, resulting in a subsequent increase in tubing diameter and wherein the drill bit may be retrieved through the expanded tubing.

22 Claims, 3 Drawing Sheets

U.S. PATENT DOCUMENTS

| | | | | |
|---|---|---|---|---|
| 2,017,451 | A | 10/1935 | Wickersham | 166/10 |
| 2,214,226 | A | 9/1940 | English | 166/1 |
| 2,383,214 | A | 8/1945 | Prout et al. | 153/82 |
| 2,424,878 | A | 7/1947 | Crook | 154/82 |
| 2,499,630 | A | 3/1950 | Clark | 153/81 |
| 2,519,116 | A | 8/1950 | Crake | 166/10 |
| 2,627,891 | A | 2/1953 | Clark | 153/82 |
| 2,633,374 | A | 3/1953 | Boice | 285/118 |
| 2,663,073 | A | 12/1953 | Bieber et al. | 29/148 |
| 2,898,971 | A | 8/1959 | Hempel | 153/82 |
| 3,028,915 | A | 4/1962 | Jennings | 166/16 |
| 3,039,530 | A | 6/1962 | Condra | 166/55 |
| 3,087,546 | A | 4/1963 | Wooley | 166/46 |
| 3,167,122 | A | 1/1965 | Lang | 166/14 |
| 3,179,168 | A | 4/1965 | Vincent | 166/14 |
| 3,186,485 | A | 6/1965 | Owen | 166/63 |
| 3,191,677 | A | 6/1965 | Kinley | 166/14 |
| 3,191,680 | A | 6/1965 | Vincent | 166/46 |
| 3,195,646 | A | 7/1965 | Brown | 166/208 |
| 3,203,451 | A | 8/1965 | Vincent | 138/143 |
| 3,203,483 | A | 8/1965 | Vincent | 166/207 |
| 3,245,471 | A | 4/1966 | Howard | 166/46 |
| 3,297,092 | A | 1/1967 | Jennings | 166/207 |
| 3,326,293 | A | 6/1967 | Skipper | 166/150 |
| 3,353,599 | A | 11/1967 | Swift | 166/15 |
| 3,354,955 | A | 11/1967 | Berry | 166/14 |
| 3,467,180 | A | 9/1969 | Pensotti | 165/180 |
| 3,477,506 | A | 11/1969 | Malone | 166/207 |
| 3,489,220 | A | 1/1970 | Kinley | 166/277 |
| 3,583,200 | A | 6/1971 | Cvijanovic et al. | 72/393 |
| 3,669,190 | A | 6/1972 | Sizer et al. | 166/315 |
| 3,689,113 | A | 9/1972 | Blaschke | 285/90 |
| 3,691,624 | A | 9/1972 | Kinley | 29/523 |
| 3,712,376 | A | 1/1973 | Owen et al. | 166/277 |
| 3,746,091 | A | 7/1973 | Owen et al. | 166/207 |
| 3,776,307 | A | 12/1973 | Young | 166/125 |
| 3,780,562 | A | 12/1973 | Kinley | 72/479 |
| 3,785,193 | A | 1/1974 | Kinley et al. | 72/393 |
| 3,818,734 | A | 6/1974 | Bateman | 72/75 |
| 3,820,370 | A | 6/1974 | Duffy | 72/75 |
| 3,911,707 | A | 10/1975 | Minakov et al. | 72/76 |
| 3,948,321 | A | 4/1976 | Owen et al. | 166/277 |
| 3,977,076 | A | 8/1976 | Vieira et al. | 30/103 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,319,393 | A | 3/1982 | Pogonowski | 29/434 |
| 4,324,407 | A | 4/1982 | Upham et al. | 277/27 |
| 4,349,050 | A | 9/1982 | Bergstrom et al. | 138/147 |
| 4,359,889 | A | 11/1982 | Kelly | 72/62 |
| 4,362,324 | A | 12/1982 | Kelly | 285/119 |
| 4,382,379 | A | 5/1983 | Kelly | 73/46 |
| 4,387,502 | A | 6/1983 | Dom | 29/568 |
| 4,407,150 | A | 10/1983 | Kelly | 72/61 |
| 4,414,739 | A | 11/1983 | Kelly | 29/727 |
| 4,429,620 | A | 2/1984 | Burkhardt et al. | 91/395 |
| 4,445,201 | A | 4/1984 | Pricer | 365/154 |
| 4,450,612 | A | 5/1984 | Kelly | 72/62 |
| 4,470,280 | A | 9/1984 | Kelly | 72/61 |
| 4,483,399 | A | 11/1984 | Colgate | 166/308 |
| 4,487,630 | A | 12/1984 | Crook et al. | 75/123 B |
| 4,502,308 | A | 3/1985 | Kelly | 72/58 |
| 4,505,142 | A | 3/1985 | Kelly | 72/54 |
| 4,505,612 | A | 3/1985 | Shelley, Jr. | 405/101 |
| 4,531,581 | A | 7/1985 | Pringle et al. | 166/120 |
| 4,567,631 | A | 2/1986 | Kelly | 29/157.3 |
| 4,581,617 | A | 4/1986 | Yoshimoto et al. | 346/108 |
| 4,588,030 | A | 5/1986 | Blizzard | 166/120 |
| 4,626,129 | A | 12/1986 | Kothmann et al. | 405/43 |
| 4,697,640 | A | 10/1987 | Szarka | 166/120 |
| 4,750,559 | A * | 6/1988 | Greenlee et al. | 166/216 |
| 4,807,704 | A | 2/1989 | Hsu et al. | 166/313 |
| 4,848,469 | A | 7/1989 | Baugh et al. | 166/382 |
| 4,866,966 | A | 9/1989 | Hagan | 72/75 |
| 4,883,121 | A | 11/1989 | Zwart | 166/217 |
| 4,976,322 | A | 12/1990 | Abdrakhmanov et al. | 175/57 |
| 4,997,320 | A | 3/1991 | Hwang | 408/22 |
| 5,014,779 | A | 5/1991 | Meling et al. | 166/55.7 |
| 5,052,483 | A | 10/1991 | Hudson | 166/55 |
| 5,052,849 | A | 10/1991 | Zwart | 403/300 |
| 5,156,209 | A | 10/1992 | McHardy | 166/324 |
| 5,267,613 | A | 12/1993 | Zwart et al. | 166/178 |
| 5,271,472 | A | 12/1993 | Leturno | 175/107 |
| 5,301,760 | A | 4/1994 | Graham | 175/61 |
| 5,307,879 | A | 5/1994 | Kent | 166/382 |
| 5,322,127 | A | 6/1994 | McNair et al. | 166/313 |
| 5,348,095 | A | 9/1994 | Worrall et al. | 166/380 |
| 5,366,012 | A | 11/1994 | Lohbeck | 166/277 |
| 5,409,059 | A | 4/1995 | McHardy | 166/208 |
| 5,435,400 | A * | 7/1995 | Smith | 175/61 |
| 5,472,057 | A | 12/1995 | Winfree | 175/57 |
| 5,520,255 | A | 5/1996 | Barr et al. | 175/24 |
| 5,553,679 | A | 9/1996 | Thorp | 175/73 |
| 5,560,426 | A | 10/1996 | Trahan et al. | 166/120 |
| 5,636,661 | A | 6/1997 | Moyes | 137/614.2 |
| 5,667,011 | A | 9/1997 | Gill et al. | 166/295 |
| 5,685,369 | A | 11/1997 | Ellis et al. | 166/195 |
| 5,706,905 | A | 1/1998 | Barr | 175/61 |
| 5,785,120 | A | 7/1998 | Smalley et al. | 166/55 |
| 5,887,668 | A | 3/1999 | Haugen et al. | 175/79 |
| 5,901,787 | A | 5/1999 | Boyle | 166/135 |
| 5,901,789 | A | 5/1999 | Donnelly et al. | 166/381 |
| 5,924,745 | A | 7/1999 | Campbell | 285/90 |
| 5,960,895 | A | 10/1999 | Chevallier et al. | 175/27 |
| 5,979,571 | A | 11/1999 | Scott et al. | 175/61 |
| 6,021,850 | A | 2/2000 | Wood et al. | 166/380 |
| 6,029,748 | A | 2/2000 | Forsyth et al. | 166/380 |
| 6,070,671 | A | 6/2000 | Cumming et al. | 166/381 |
| 6,098,717 | A | 8/2000 | Bailey et al. | 166/382 |
| 6,155,360 | A * | 12/2000 | McLeod | 175/258 |

FOREIGN PATENT DOCUMENTS

| | | | |
|---|---|---|---|
| EP | 0 952 305 A1 | 4/1998 | E21B/43/10 |
| EP | 0 961 007 A2 | 12/1999 | E21B/33/10 |
| GB | 730338 | 3/1954 | 84/4 |
| GB | 792886 | 4/1956 | |
| GB | 997721 | 7/1965 | |
| GB | 1277461 | 6/1972 | B21D/39/04 |
| GB | 1448304 | 9/1976 | E21B/33/13 |
| GB | 1457843 | 12/1976 | B21D/39/10 |
| GB | 1582392 | 1/1981 | B21D/39/10 |
| GB | 2216926 A | 10/1989 | E21B/7/20 |
| GB | 2 313 860 B | 6/1996 | E21B/10/34 |
| GB | 2 320 734 A | 7/1998 | E21B/33/127 |
| GB | 2329918 A | 4/1999 | E21B/43/10 |
| WO | WO 92/01139 | 1/1992 | E21B/17/08 |
| WO | WO 93/24728 | 12/1993 | E21B/17/10 |
| WO | WO 93/25800 | 12/1993 | E21B/43/10 |
| WO | WO 94/25655 | 11/1994 | D04C/1/06 |
| WO | WO 97/21901 | 6/1997 | E21B/17/08 |
| WO | WO 98/00626 | 1/1998 | E21B/43/10 |
| WO | WO 99/02818 | 1/1999 | E21B/43/10 |
| WO | WO 99/18328 | 4/1999 | E21B/23/01 |
| WO | WO 99/23354 | 5/1999 | E21B/43/10 |

OTHER PUBLICATIONS

PCT International Search Report from PCT/GB 99/04246, Dated Mar. 03, 2000.

UK Search Report from GB 9930398.4, Dated Jun. 27, 2000.
U.S. patent application Ser. No. 09/470,176, Metcalfe et al., filed Dec. 22, 1999.
U.S. patent application Ser. No. 09/470,154, Metcalfe et al., filed Dec. 22, 1999.
U.S. patent application Ser. No. 09/469,681, Metcalfe et al., filed Dec. 22, 1999.
U.S. patent application Ser. No. 09/469,526, Metcalfe et al., filed Dec. 22, 1999.

* cited by examiner

METHOD AND APPARATUS FOR DRILLING AND LINING A WELLBORE

BACKGROUND OF THE INVENTION

1. Field of the Invention

This invention relates to a drilling method and to drilling apparatus. In particular, aspects of the invention relate to combined bore drilling and bore isolation methods and apparatus.

2. Description of the Related Art

In oil and gas exploration and production operations, subsurface hydrocarbon-bearing formations are accessed by drilling bores from the surface to intersect with the formations. Drilling is accomplished using a drill bit mounted on the end of a drill support member, commonly known as a drill string. The drill string may be rotated via a top drive or rotary table on a surface platform or rig, or a downhole motor may be mounted towards the lower end of the string. The drilled bores are lined with steel tubing, known as "casing", which casing is cemented in the bore by filling the annulus between the casing and the surrounding bore wall with cement slurry. The casing inter alia supports the bore wall and prevents fluid flowing into or from the bore through the bore wall.

During a drilling operation it is normally the case that the drill string passes through an upper section of the bore, which is cased, and a lower and more recently drilled bore section which is uncased. While drilling, it is not uncommon for the bore to intersect formations which create difficulties for the drilling operator, including: unstable formations which collapse into the bore; swelling formations which restrict the bore and may trap the drill string in the bore; porous formations which result in loss of returning drilling fluid; and fluid-containing formations which result in uncontrolled flow of gas or liquid into the bore.

In some cases these difficulties may be overcome by, for example, pumping specialised fluids downhole to treat the problem formation. However, in other cases it may be necessary to retrieve the drill string and then run in casing or other bore liner to isolate the problem formation before drilling may recommence. Clearly, these operations will be time consuming and incur significant extra expense. Further, in the event of significant immediate problems, it may even become necessary to abandon the well.

In normal drilling operations, the sequence of events in drilling and then casing a bore is similar, that is following drilling to a desired depth the drill string is retrieved and a casing string is then made up and run into the bore.

It is among the objectives of embodiments of the present invention to provide a method and apparatus which permit bore drilling and bore isolation operations to be executed in a single "trip", that is a drill string need not be retrieved and a separate casing string run in prior to a bore lining or isolation operation being carried out.

SUMMARY OF THE INVENTION

According to the present invention there is provided a drilling method comprising: mounting a drill bit on a drill string including a section of expandable tubing; providing a tubing expander in the string; advancing the drill string through a bore; passing the expander through the expandable tubing to expand the tubing; and retrieving the drill bit from the bore, through the expanded tubing.

According to another aspect of the present invention there is provided drilling apparatus comprising: a drill string including a section of expandable tubing; a drill bit mounted on the string; and a tubing expander mounted on the string, whereby the expander is operable to expand the expandable tubing downhole such that the drill bit may be retrieved through the expanded tubing.

Thus, the invention allows a section of tubing to be expanded downhole to, for example, isolate a problem formation, and the drill bit to then be retrieved through the expanded tubing. In addition, in directional drilling, other equipment such as bent subs, motors and MWD apparatus will be mounted on the string and could also be retrieved through the expanded tubing. As the expandable tubing forms part of the drill string, conveniently forming the lowermost section of the drill string, the tubing may be put in place relatively quickly, as there is no requirement to retrieve the drill string and then run in a separate string of bore liner. The invention may also be utilised to drill and line a section of bore, which may not necessarily contain a problem formation, in a single trip. In such applications there may be occasions, for example, when the bore is not to be extended further, when the drill bit may not need to be retrieved and may be left in the sump of the bore.

The expanded tubing may be cemented in the bore.

The drill bit may be a bi-centre bit or a retractable or collapsible bit, to facilitate retrieval of the bit through the expanded tubing, and also to facilitate the drilling of relatively large bores below existing casing.

When drilling below a cased section of bore it is preferred that the length of the expandable tubing section is selected to be greater than the length of the uncased section of bore, such that there is an overlap between the existing casing and the expandable tubing; the expandable tubing may be expanded at the overlap to engage the casing, and thus create a hanger for the expanded tubing. In other embodiments the expandable tubing may he otherwise located or secured in the bore.

Preferably, the expandable tubing forms the lower section of the drill string and a drill assembly, which may consist solely of the drill bit, but which may also include directional drilling apparatus, such as bent subs, motors and MWDs, is mounted to the lower end of the expandable tubing section.

Preferably, the tubing expander is initially located in an upper part of the expandable tubing, and is advanced downwards through the tubing to expand the tubing. Most preferably, the expander and the drill bit define corresponding profiles such that, following expansion of the tubing, the expander may engage the bit and allow the bit to be retrieved with the expander. Preferably also, the coupling between the expander and the drill bit is such that there may be a transfer of torque therebetween, allowing further drilling of the bore with the drill bit coupled to the expander; this may be useful to allow expansion of the lowermost part of the expandable tubing and drilling of a pocket beyond the end of the section of bore lined with the expanded tubing.

Preferably, the expandable tubing is deformed by compressive plastic deformation or yield of the tubing, with a localised reduction in wall thickness resulting in a subsequent increase in tubing diameter. Most preferably, the deformation is achieved by rolling expansion, that is an expander member is rotated within the tubing with a face in rolling contact with an internal face of the tubing.

Preferably, the tubing expander comprises a body and one or more rolling expander members mounted on the body. The one or more expander members may be radially extendable, or may be inclined to the tubing axis to define an expansion cone. To expand the tubing, the expander is rotated and advanced through the tubing. The tubing expander may comprise a plurality of expanding sections, and in the preferred embodiment two expanding sections are provided, a first section including a plurality of rollers in a conical configuration, and a second section in which the roller axes are substantially parallel to the tubing axis. The first section may provide a degree of initial deformation by a combination of compressive and circumferential yield, while the second section may provide a subsequent degree of deformation substantially by compressive yield. Other forms of expanders may be utilised, such as a fixed cone or expansion mandrel, however the expansion mechanism of a fixed cone, that is substantially solely by circumferential yield, is such that the axial forces required to advance such a cone through expanding tubing are significantly greater than those required to advance a rolling expander through expanding tubing.

The tubing expander may be rotated from surface, or may be rotated by a downhole motor mounted to the string.

Preferably, the tubing expander is releasably axially and rotatably lockable relative to the expandable tubing, and thus may form the coupling between the expandable tubing and the remainder of the drill string. When it is desired to expand the tubing, the expander may be rotatably unlocked from the tubing. Preferably, this follows an initial deformation of a first portion of the tubing into engagement with existing casing to create an initial lock against rotation of the tubing relative to the surrounding casing. The expander is then rotated relative to the tubing to create at least a portion of a tubing hanger. The expander may then be axially unlocked to allow the expander to advance through the tubing. The lock against relative location may be provided by couplings between the expander and the tubing which are released on initial deformation of the tubing, and the axial lock may be provided via a releasable swivel.

In other embodiments it may be necessary or desirable to retain a small annulus between the expandable tubing and the casing. This allows the expanded tubing to be cemented and sealed using conventional means. Further, sufficient initial torque resistance may be provided by the expandable tubing to allow the rotary expander to initiate rotary expansion before there is any contact between the tubing and the casing; for example a ball may be dropped to allow actuation of a release tool between the expander end the tubing.

The advancement of the tubing expander through the tubing may be achieved by application of weight, or alternatively or in addition may be achieved or assisted by provision of a suitable tractor arrangement, as described in W093/24728, the disclosure of which is incorporated herein by reference. Such a tractor may include a plurality of rollers having skewed axes of rotation such that rotation of the tractor, with the rollers in contact with the surrounding tubing, produces an axial driving force. The rollers nay be urged radially outwardly, by mechanical or preferably fluid pressure force, to grip the tubing and such that the tractor may also provide for a degree of expansion of the tubing.

The expandable tubing may take any suitable form, and may be solid wall tubing, slotted or otherwise perforated tubing, or may incorporate sections of sand screen or the like. If the expanded tubing is to serve to isolate problem formations then clearly solid tubing will be preferred. The tubing may be provided with a seal arrangement, such as an elastomeric coating at the lower end thereof. Such an arrangement may be useful in situations where drilling fluid losses are being experienced to a formation that has been previously drilled. Losses could be mitigated by such a seal arrangement and would permit removal of the bit under safer well control conditions.

The drill string may take any appropriate form, and may he formed from drill pipe or from a reeled support, such as coiled tubing.

The expandable tubing may be expanded to a diameter close to the diameter of the drilled bore, and may be expanded such that the tubing contacts the bore wall.

According no a further aspect of the present invention there is provided a drilling method comprising mounting a drill bit on a drill string including a section of expandable tubing; providing a tubing expander In the string; advancing the drill string through a bore; and passing the expander through the expandable tubing to expand the tubing by compressive yield.

According to a still further aspect of the present invention there is provided drilling apparatus comprising: a drill string including a section of expandable tubing; a drill bit mounted on the string; and a tubing expander mounted on the string, the expander having at least one rolling expander member, whereby the expander is operable to expand the expandable tubing downhole by rolling expansion to produce compressive yield.

BRIEF DESCRIPTION OF THE DRAWINGS

These and other aspects of the present invention will now be described, by way of example, with reference to the accompany drawings, in which.

DETAILED DESCRIPTION OF THE PREFERRED EMBODIMENT

Figure 1:
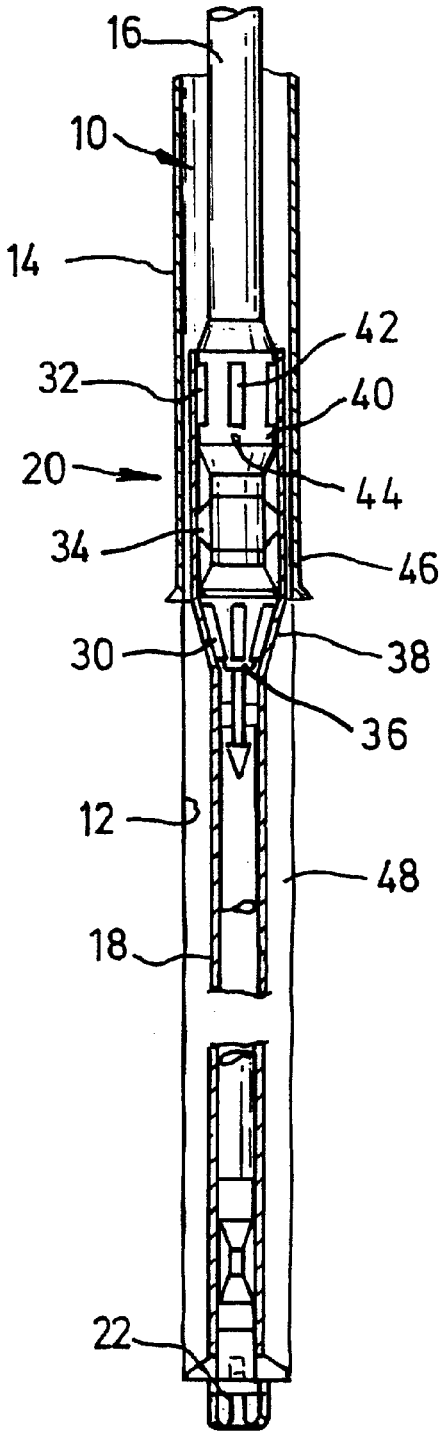
FIGS. 1 through 7 are schematic part sectional views showing the sequence of a bore drilling and isolation method in accordance with the preferred embodiment of the present invention.
Figure 2:
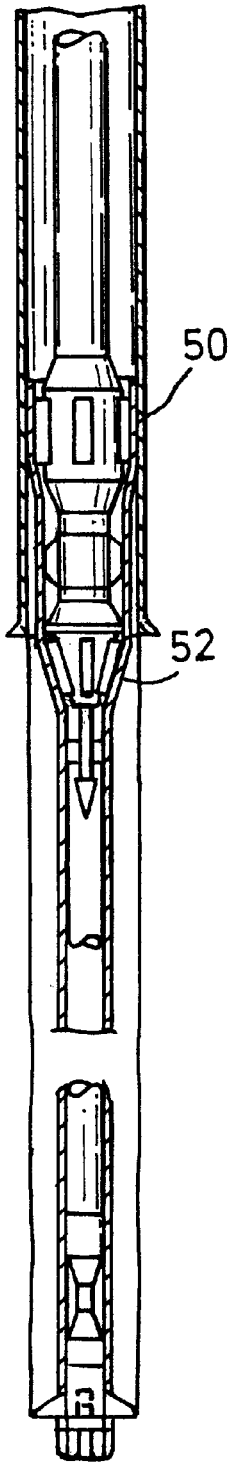
Figure 3:
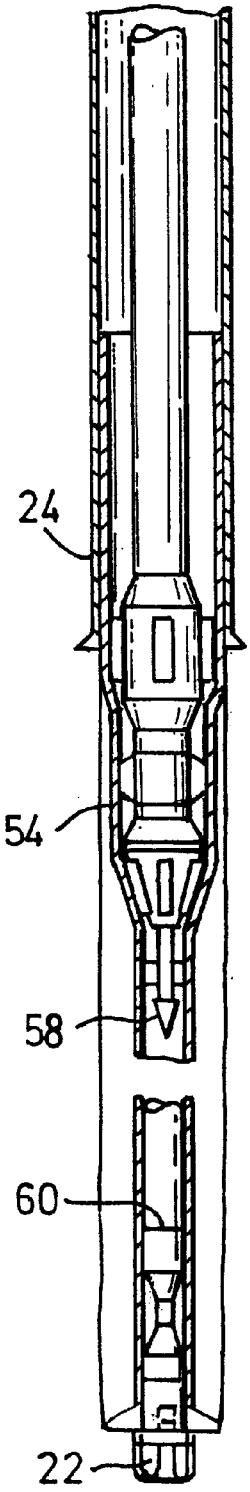
Figure 4:
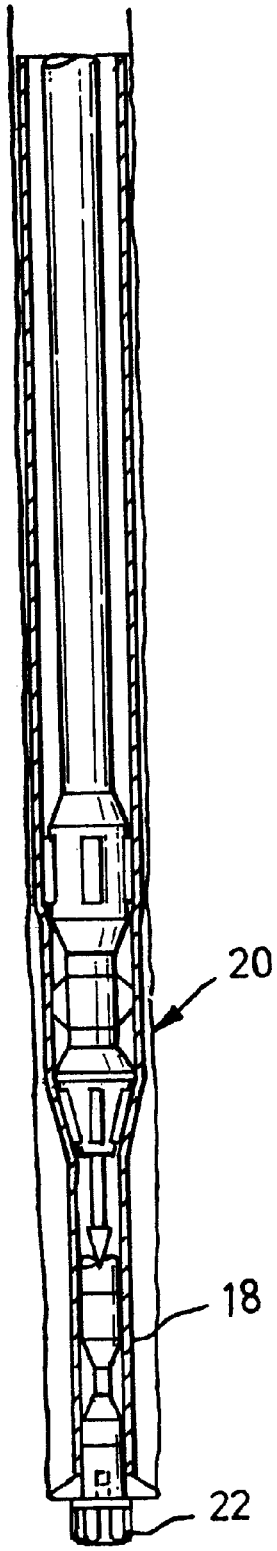
Figure 5:
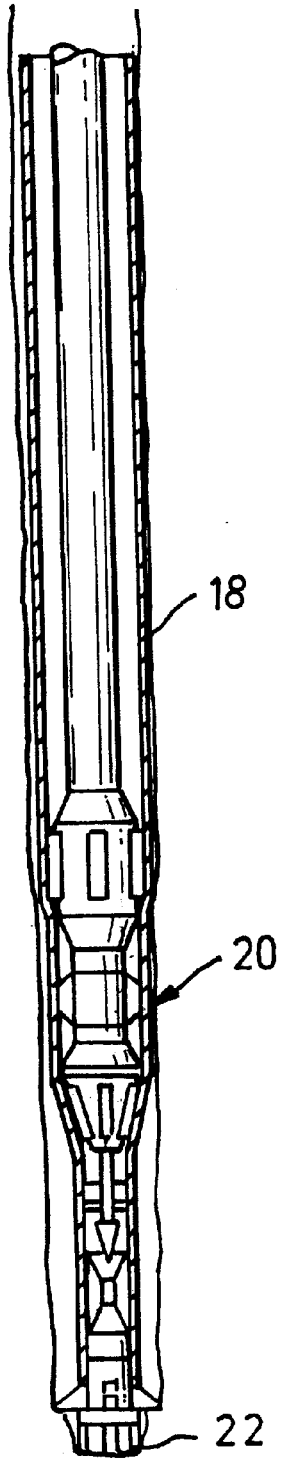
Figure 6:
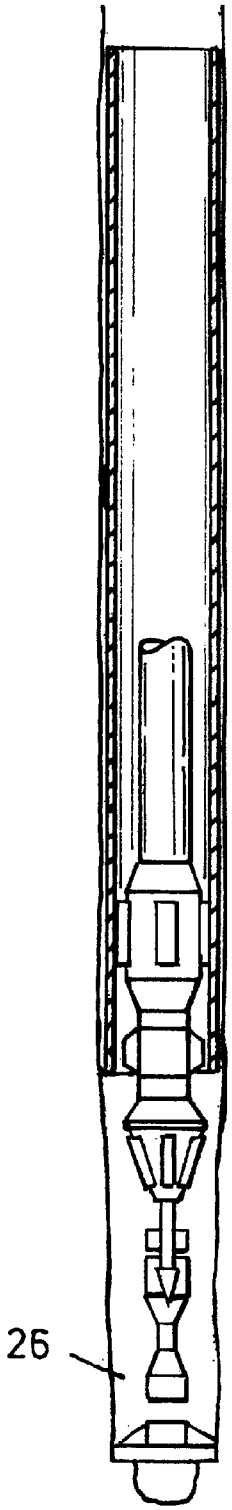
Figure 7:
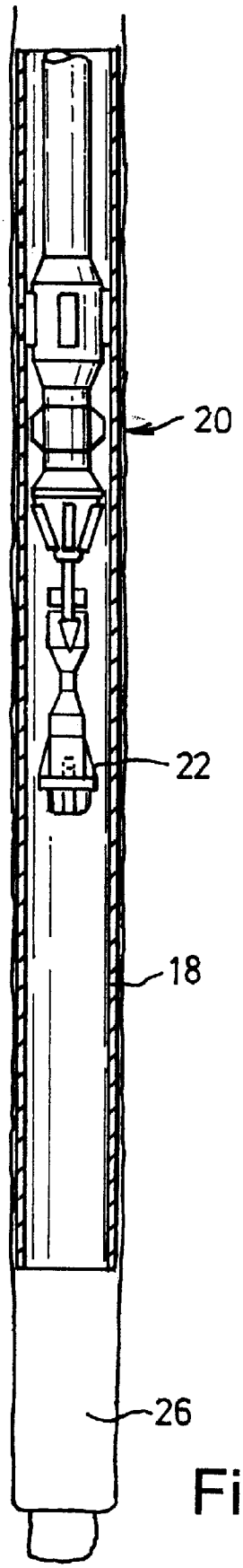

The drawings illustrate the sequence of a drilling operation in accordance with an embodiment of one aspect of the present invention, utilising apparatus of an embodiment of another aspect of the present invention. Reference is first made in particular to FIG. 1 of the drawings, which illustrates the lower section of a drill string 10 being utilised to drill and extend a bore 12 below an existing section of bore which has previously been lined with casing 14. The string 10 comprises conventional drill pipe 16, which extends to the surface, and a section of expandable tubing 18 coupled to the lower end of the drill pipe section 16 via an expander 20. The expandable tubing 18 extends through the uncased section of the bore 12 and provides mounting for a drill assembly including a collapsible drill bit 22. During drilling, the string 10 is rotated from surface and weight is also applied to the string 10, such that the drill bit 22 advances the bore 12. When the bore 12 has been drilled to the desired depth, the expander 20 is activated to form a tubing hanger 24 to locate the tubing relative to the casing 14 (see FIGS. 2 and 3). The expander 20 is then advanced through the tubing 18, and expands the tubing 18 to a diameter close to the bore diameter (FIG. 4). The expander 20 then engages the drill bit 22 (FIG. 5), and drilling may then recommence, beyond the end of the tubing 18, simultaneously with the expansion of the lower end of the tubing 18 (FIG. 6). The drill bit 22 is then collapsed and the string 10, including the expander 20 and the drill bit 22, may be retrieved, leaving the expanded tubing 18 in the bore with a pocket 26 therebelow.

The apparatus and method will now be described in greater detail. The expander 20 comprises first and second expander sections 30, 32, with a releasable swivel 34 therebetween. The first expander section 30 features a 20 conical body 36 which provides mounting for a number of inclined axis rollers 38, the roller axes and roller profiles being arranged such that there is minimal skidding between the rollers 38 and an adjacent conical contact surface. The second expander section 32 comprises a generally cylindrical body 40 carrying a plurality of parallel axis rollers 42. The rollers 42 are mounted on pistons and are radially extendable by application of elevated fluid pressure to the interior of the expander section body 40. Further, the second expander section body 40 carries coupling pins 44 which, initially at least, en gage the upper end of the tubing 18 and allow transfer of rotational torque from the drill pipe 16, though the expander 20, to the tubing 18.

The swivel 34 engages the tubing 18 and, initially at least, provides axial support for the tubing 18.

The length of the tubing 18 is selected to correspond to the length of the uncased section of the bore which will extend beyond the end of the casing 14 following completion of an initial drilling stage, with allowance for a suitable overlap 46 between the lower end of the casing 14 and the upper end of the expandable tubing 18. FIG. 1 illustrates the point in the drilling operation when the initial drilling stage has been completed. It will be noted that the expander 20 is located in the upper end portion of the expandable tubing 18 which provides the overlap 46.

During the drilling operation, drilling mud will have been circulated through the drill string 10 to the drill bit 22, and returning through the annulus 48 between the tubing and the bore wall. On reaching the desired depth, as illustrated in FIG. 1, the flow of drilling fluid is increased, leading to an increase in the internal fluid pressure within the expander 20. This activates the second expander section, such that the rollers 42 are extended radially outwardly, and deform the upper end of the tubing 18 to create contact areas 50 between the tubing 18 and the casing 14 externally of the rollers 42. This deformation also disengages the tubing 18 from the pins 44. Thus, the expander 20 may then be rotated relative to the cubing 18, which is now fixed against rotation relative to the casing 14. The rotation of the expander 20, with the rollers 42 of the second expander section 32 radially extended, results in the deformation of the upper end of the expandable tubing 18 to create an annular section of increased diameter which forms an interference fit with the casing 14, and thus creates a tubing hanger 24. The rolling expansion of the tubing 18 results in the wall of the tubing 18 being subject to compressive yield, and the decrease of tubing wall thickness leading to a corresponding increase in tubing diameter.

The tubing 18 is now securely hung from the casing 14, and the swivel 34 may therefore be released, for example by virtue of a mechanism which is operable by a combination of application of elevated internal fluid pressure and axial force.

With the elevated fluid pressure still being applied to the expander interior, and the expander 20 being rotated, weight is applied to the string, resulting in the expander 20 advancing through the tubing 18.

The first expander section 30 is initially located in a cross-over portion of the tubing 52 where the diameter of the cubing 18 changes from a relatively small diameter to the larger diameter upper end accommodating the expander 20. During the expansion operation, the first expander section rollers 38 move in rolling contact around the inner wall of the tubing 18, and expand the tubing to an intermediate diameter 54 by a combination of circumferential and compressive yield. The second expander section 32 produces a further expansion of the tubing 18, mainly by virtue of compressive yield.

The first stage of the expansion operation continues until a profiled member 58 extending from the expander 20 engages a corresponding female profile 60 in the upper end of the drill bit 22. On engagement of the profiles 58, 60, the drill bit 22 rotates with the expander 20, and extends the bore beyond the lower end of the tubing 18. This allows the end portion of the tubing 18 to be expanded, and also provides an uncased pocket 26 at the end of the bore 12. The string 10 may then be retrieved from the bore, together with the expander 20 and drill bit 22.

It will be apparent to those of skill in the art that the above-described embodiment offers significant time savings over conventional drilling and casing operations as it allows for drilling of a section of bore, and location of casing in a bore, in a single trip. This may he useful in conventional drilling and casing operations, and also may be useful for isolating problem formations encountered during a drilling operation.

It will also be apparent to those of skill in the art that the above-described embodiment is merely exemplary of the present invention, and that various modifications and improvements may be made thereto, without departing from the scope of the present invention. In the above described embodiment, the expandable tubing is deformed initially to create a tubing hanger. In other embodiments a small gap or annulus may be provided between the expanded tubing and the casing, to facilitate cementing of the expanded tubing, and allowing use of other hanging and sealing arrangements. Also, in the above described embodiment a pocket is drilled beyond the end of the expandable tubing. In other embodiments, the expander may be provided with a female bit recovery device with a telescopic action, allowing complete expansion of the tubing without the need for further drilling. This may be desirable in situations where the bit has been blunted, nozzles have packed off, the bit has become stuck or other events have occurred that make drilling difficult or impossible.

In the above embodiment expander actuation is achieved by increasing pump rates. In other embodiments, particularly where there is no requirement to drill a pocket, the expander may be actuated by dropping a ball through the string to engage a sleeve or the like to permit opening of fluid passages to allow fluid pressure actuation of the expander.

What is claimed is:

1. A drilling apparatus comprising:

a drill string including a section of expandable tubing;

a drill bit mounted on the string; and a tubing expander mounted on the string, wherein the expandable tubing is deformable by compressive plastic deformation of the tubing with a localised reduction in wall thickness, resulting in a subsequent increase in tubing diameter and wherein the drill bit may be retrieved through the expanded tubing, wherein the drill bit is a collapsible bit.

2. A drilling apparatus comprising:

a drill string including a section of expandable tubing;

a drill bit mounted on the string; and a tubing expander mounted on the string, wherein the expandable tubing is deformable by compressive plastic deformation of the tubing with a localised reduction in wall thickness, resulting in a subsequent increase in tubing diameter and wherein the drill bit may be retrieved through the expanded tubing, wherein the drill bit is a bi-centred bit.

3. A drilling apparatus comprising:

a drill string including a section of expandable tubing;

a drill bit mounted on the string;

a tubing expander mounted on the string wherein the expandable tubing is deformable by compressive plastic deformation of the tubing with a localised reduction in wall thickness, resulting in a subsequent increase in tubing diameter and wherein the drill bit may be retrieved through the expanded tubing; and a drill assembly mounted to the lower end of the expandable tubing section.

4. The apparatus of claim 3, wherein the drill assembly comprises the drill bit.

5. The apparatus of claim 4, wherein the expander and drill assembly each comprise a corresponding profile so that the expander may engage the bit and allow the bit to be retrieved with the expander.

6. The apparatus of claim 5, wherein the engagement between said profiles is such that there may be a transfer of torque therebetween.

7. A drilling apparatus comprising:

a drill string including a section of expandable tubing;

a drill bit mounted on the string; and a tubing expander mounted on the string, wherein the expandable tubing is deformable by compressive plastic deformation of the tubing with a localised reduction in wall thickness, resulting in a subsequent increase in tubing diameter and wherein the drill bit may be retrieved through the expanded tubing, wherein a lower portion of the expandable tubing carries an external seal arrangement for cooperating with the surrounding bore wall.

8. A drilling apparatus comprising:

a drill string including a section of expandable tubing;

a drill bit mounted on the string; and a tubing expander mounted on the string, wherein the expandable tubing is deformable by compressive plastic deformation of the tubing with a localised reduction in wall thickness, resulting in a subsequent increase in tubing diameter and wherein the drill bit may be retrieved through the expanded tubing, wherein the tubing expander comprises a body and at least one rolling expander member mounted on the body.

9. The apparatus of claim 8, wherein the at least one rolling expander member is radially extendable.

10. The apparatus of claim 9, wherein the at least one rolling expander member is inclined to the tubing axis to define an expansion cone.

11. The apparatus of claim 8, wherein the tubing expander comprises at least two roller expanding sections, a first section including a plurality of rollers in a conical configuration, and a second section including a plurality of rollers having roller axes which are substantially parallel to the tubing axis.

12. The apparatus of claim 8, wherein the tubing expander is at least one of releasably axially and rotatably locked relative to the expandable tubing, and forms a coupling between the expandable tubing and the remainder of the drill string.

13. The apparatus of claim 12, wherein the rotation lock is in the form of couplings between the expander and the tubing which are releaseable on initial deformation of the tubing.

14. The apparatus of claim 12, wherein the axial lock is a releasable swivel.

15. An apparatus for lining and drilling a wellbore, comprising;

an expandable tubular;

a drill assembly having a drill bit; and a tubing expander comprising one or more radially extendable members that are directly fluid pressure actuated.

16. The apparatus of claim 15, wherein the expander and drill assembly each comprise a corresponding profile so that the expander may engage the drill assembly and allow the drill assembly to be retrieved with the expander.

17. The apparatus of claim 16, wherein the engagement between the corresponding profiles is such that there may be a transfer of torque there-between.

18. The apparatus of claim 15, wherein the expandable tubular is deformed by compressive plastic deformation of the tubular with a localised reduction in wall thickness, resulting in a subsequent increase in tubing diameter.

19. A method for lining and drilling a wellbore, comprising:

running a drill string into the wellbore, the drill string comprising:

an expandable tubular;

a drill assembly having a drill bit; and a tubing expander comprising one or more radially extendable members that are directly fluid pressure actuated;

rotating the drill bit and advancing the drill string through the wellbore;

plastically deforming at least a portion of the expandable tubular by rolling expansion; and retrieving the drill string from the bore.

20. The method of claim 19, wherein the expander and drill assembly each comprise a corresponding profile for engaging the expander and the drill assembly.

21. The method of claim 20, wherein the profiles for engaging the expander and the drill assembly permit transfer of torque there-between so that drilling of the bore, after the engagement, is carried out with the drill bit coupled to the expander.

22. An apparatus for lining and drilling a wellbore, comprising;

an expandable tubular having a constant diameter;

a drill assembly having a drill bit; and a tubing expander comprising one or more radially extendable members that are directly fluid pressure actuated;

wherein the diameter of the expandable tubular is uniformly increased within the wellbore.

* * * * *